United States Patent [19]

Minck

[11] 4,108,743

[45] Aug. 22, 1978

[54] METHOD AND APPARATUS FOR SEPARATING A METAL FROM A SALT THEREOF

[75] Inventor: Robert W. Minck, Lathrup Village, Mich.

[73] Assignee: Ford Motor Company, Dearborn, Mich.

[21] Appl. No.: 793,105

[22] Filed: May 2, 1977

[51] Int. Cl.[2] ..... C25C 3/00

[52] U.S. Cl. ..... 204/64 R

[58] Field of Search ..... 204/64 R, 68

[56] References Cited

U.S. PATENT DOCUMENTS

| | | | |
|---|---|---|---|
| 3,118,827 | 1/1964 | Eckert et al. | 204/68 |
| 3,488,271 | 1/1970 | Kummer et al. | 204/68 |
| 3,712,858 | 1/1973 | Ross | 204/68 |

*Primary Examiner*—John H. Mack
*Assistant Examiner*—H. A. Feeley
*Attorney, Agent, or Firm*—Roger L. May; Keith L. Zerschling

[57] ABSTRACT

An improved apparatus and method relating to the separation of a metal from its electrically dissociable molten salt by electrically attracting the cations thereof through a solid electrolyte and converting them to elemental metal at a cathode. The improvement comprises disposing a secondary molten electrolyte adjacent to and contiguous with the side of said solid electrolyte in closest proximity with said recovered metal such that the cations of said metal being recovered are reduced at the interface between said secondary electrolyte and the recovered molten metal rather than in or adjacent to the surface of the solid electrolyte.

43 Claims, 5 Drawing Figures

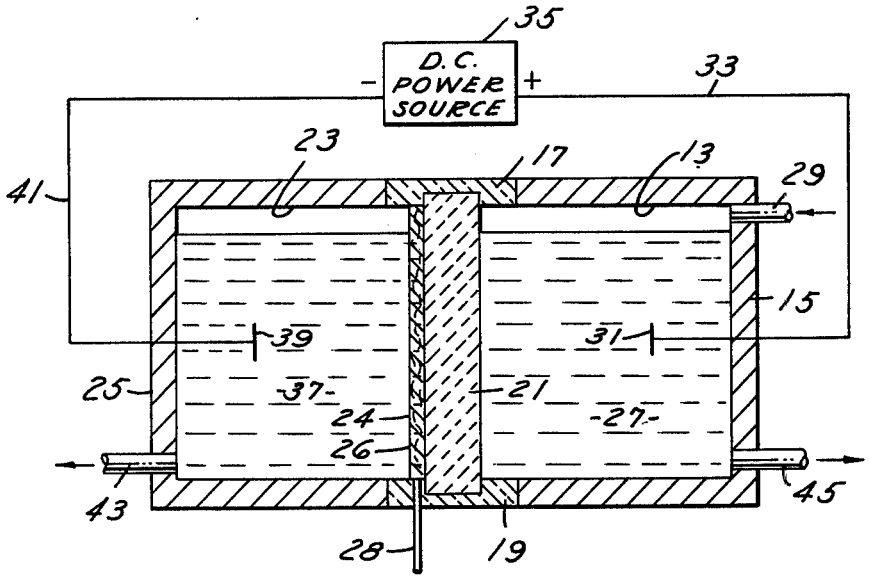
FIG. 1
FIG. 2
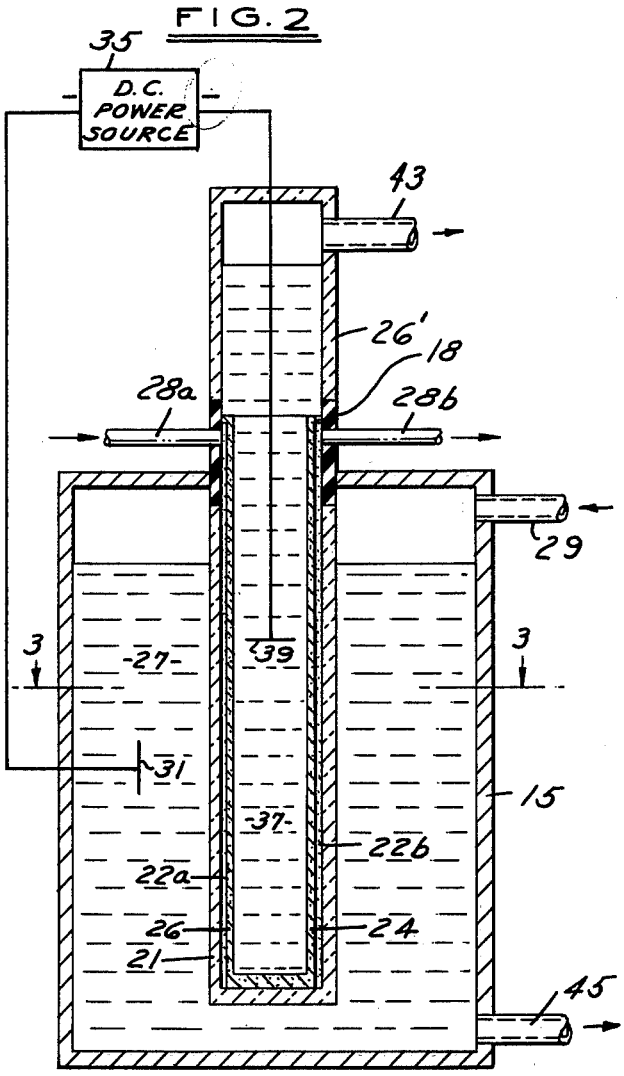
FIG. 3
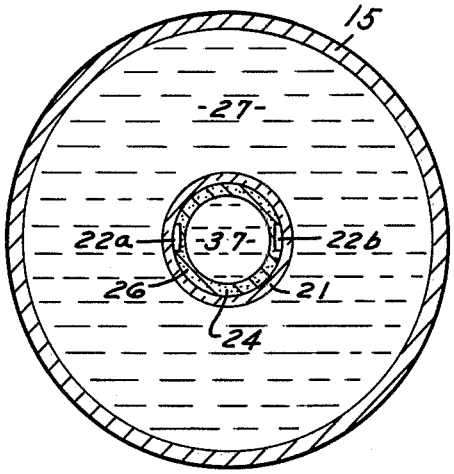

METHOD AND APPARATUS FOR SEPARATING A METAL FROM A SALT THEREOF

BACKGROUND OF THE INVENTION

The invention described and claimed herein relates to an electrochemical method for separating a metal from a salt thereof and an apparatus for performing the same. In particular, this invention relates to an improved method and apparatus of the type wherein a metal is separated from an electrically dissociable molten salt thereof by electrically dissociating the cations of the metal and the salt from the anions of the salt, passing the cations through a solid electrolyte that is selectively conductive to the cations and impermeable to the anions, and reducing the cations to elemental metal. U.S. Pat. No. 3,488,271 issued Jan. 6, 1970 to Kummer et al discloses and claims such a method for separating a metal from a salt.

Although the method disclosed and claimed in the Kummer et al patent is effective for separating metal from its electrically dissociable salt, the method and the apparatus for performing the method suffer from certain disadvantages relating to the degradation of the solid electrolyte, most commonly a beta-type alumina ceramic. Although the mechanism by which the solid electrolyte degrades, thereby shortening the life of the apparatus and decreasing the rate of metal separation, is not known, it is surmised that the degradation or cracking of the solid electrolyte ceramic results from reduction of the metal cation at the surface of the solid electrolyte. One possibility is that the reduction of the cation occurs in microfissures or cracks in the ceramic causing further cracking of the ceramic to occur or be propagated and resulting in a necessary limitation of allowable current density. A still further possible cause of ceramic degradation and decreased performance could be reduction at the interface of the solid electrolyte of cationic impurities which may be present in the dissociable salt being electrolyzed. Such impurities may be solid at the cell operating temperature, thus resulting in dendritic growth of impurity metals around and through the ceramic.

It is the object of this invention to modify the prior art apparatus and method in such a manner as to reduce or sub stantially eliminate solid electrolyte degradation, thereby increasing the permissible rate of metal separation and the life of the separation cell.

BRIEF DESCRIPTION OF THE INVENTION

The improvement of the invention comprises disposing a secondary molten electrolyte adjacent to and contiguous with the solid electrolyte of the apparatus used in the performance of the method on the side thereof which is exposed to the recovered molten metal, such that the cations of the metal being recovered are reduced at the interface between the secondary electrolyte and the recovered molten metal rather than in or adjacent the surface of the solid electrolyte. The secondary electrolyte comprises a molten salt of the metal being recovered and is (i) ionically conductive to said metal being recovered, (ii) substantially electronically insulating, (iii) substantially insoluble in said recovered molten metal and (iv) nonreactive with the solid electrolyte and the recovered molten metal. The secondary electrolyte may either be disposed so as to be maintained in position by gravity or it may be supported or dispersed in a layer of porous material which (i) exhibits a contact angle with said secondary electrolyte which is less than the contact angle which it exhibits with said recovered molten metal, i.e., is more readily wetted by the secondary electrolyte than by the molten metal, (ii) is nonreactive with the recovered molten metal, the secondary electrolyte and the solid electrolyte and (iii) is substantially electronically insulating. The secondary electrolyte may also comprise a mixture of mutually soluble molten salts, at least one of which is a salt of the metal being recovered. The process and the apparatus of the invention may also include a means by which the secondary electrolyte may be replenished by supplying additional molten secondary electrolyte salt to the vicinity of the surface of the solid electrolyte. The secondary electrolyte may be continuously supplied and withdrawn to and from the vicinity of the surface of the solid electrolyte.

In preferred embodiments of the invention the apparatus thereof comprises: (A) a container; (B) a tubular solid electrolyte which is disposed within the container so as to create a first half-cell compartment between the tubular solid electrolyte and the container and a second half-cell compartment within the solid electrolyte, one of the compartments being adapted to contain the dissociable salt and the other of said compartments being adapted to receive and hold the recovered metal; and (C) a secondary electrolyte adjacent to and contiguous with the surface of the tubular solid electrolyte which is exposed to the compartment adapted to receive and hold the recovered metal; and (D) suitable electrodes and a source of electrical energy such that a difference of electrical potential may be maintained between said electrodes in polarity arrangement adapted to cause unidirectional flow of cations of said metal from said salt through said solid electrolyte and said secondary electrolyte and convert said cations to elemental metal; and (E) storage compartments to supply or extract the "feed stock" (dissociable molten salt), the recovered metal, and the reaction products formed by the dissociation process.

In one particularly preferred embodiment of this preferred apparatus the secondary electorlyte is disposed along the surface of the tubular solid electrolyte in such a manner as to leave axially extending slots adapted to assist in the distribution of additional secondary electrolyte during performance of the process. In a second particularly preferred apparatus wherein the compartment adapted to receive the recovered molten metal is within said second half-cell compartment and the secondary electrolyte is disposed around the interior surface of the tubular solid electrolyte, a porous electronically conductive cathode structure is disposed inside the secondary electrolyte at the interface between the secondary electrolyte and the recovered molten metal. Most preferably this porous cathode structure is formed from a porous material consisting of expanding grooves or holes so as to be stable against an excess pressure in the molten salt compared to the pressure in the recovered metal.

The invention will be more fully understood after reading the following detailed description of the invention in conjunction with the drawings in which:

FIG. 1 shows a vertical sectional view of a separating apparatus suitable for carrying out the process;

FIG. 2 shows a vertical sectional view of a preferred embodiment of the apparatus of the invention suitable for carrying out the process wherein the solid electrolyte and the container are both tubular;

FIG. 3 shows a horizontal cross section of the apparatus of FIG. 2;

DETAILED DESCRIPTION OF THE INVENTION

Figure 4:
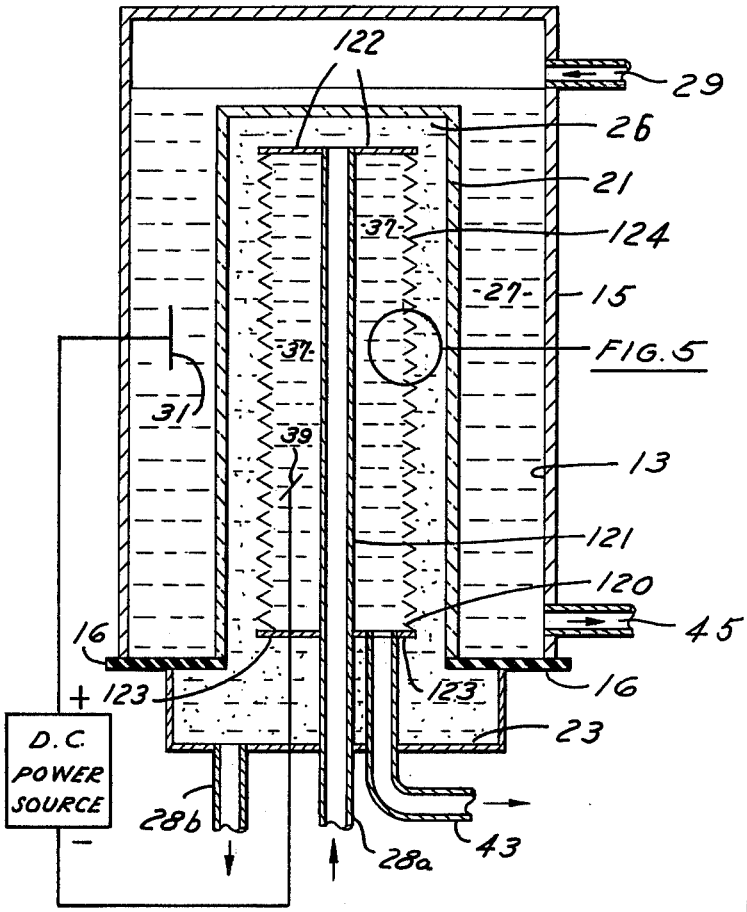
FIG. 4 shows a second preferred apparatus of the invention suitable for carrying out the process wherein a porous cathode structure is disposed at the interface between the secondary electolyte and the molten recovered metal.
Figure 5:
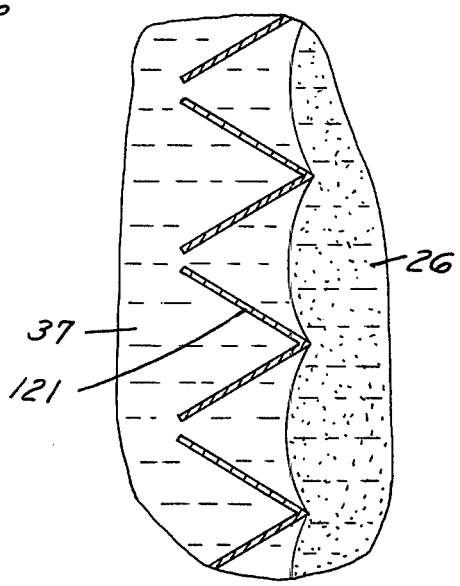
FIG. 5 shows a blown up view of a portion of the cathode structure of FIG. 4 and its relationship to the secondary electrolyte and recovered molten metal.

As discussed above, the invention relates to an electrochemical method and apparatus for performing that method, whereby a metal is recovered from an electrically dissociable salt thereof by placing the salt in a molten state in contact with one side of a solid electrolyte which is impermeable to the metal, the salt and the anion of the salt, and which is selectively conductive with respect to cations of the metal and the salt, providing a first electrode in contact with the salt on one side of the solid electrolyte, providing a second electrode in contact with the metal on the opposite side of the solid electrolyte and providing a difference of electrical potential between the first electrode and the second electrode in polarity arrangement so as to cause unidirectional flow of cations of the metal from the salt through the solid electrolyte and convert the cation to elemental metal.

An apparatus and method of this type is described, as mentioned above, in U.S. Pat. No. 3,488,271 to Kummer et al. The Kummer et al patent described in some detail various solid electrolytes which may be employed in such a device. Still further description of various solid electrolyte materials falling within the scope of those useful in this invention are described and discussed in some detail in the following U.S. patents: U.S. Pat. Nos. 3,404,035; 3,404,036; 3,413,150; 3,475,220; 3,475,225; 3,535,163; 3,719,531; 3,966,492; 3,976,503; 3,984,500 and 3,985,575. Each of the mentioned patents disclose beta-type alumina bi- or multi-metal oxide ceramic cation-permeable barriers which are useful in the devices and for the method of this invention. All of the solid electrolytes of the family of beta-alumina exhibit a generic crystalline structure which is readily identifiable by X-ray diffraction. The materials can be thought of as a series of layers of aluminum oxide held apart by columns of linear A1-O bond chains.

As mentioned briefly above, the improvement of this invention comprises a method and apparatus wherein a secondary electrolyte is disposed adjacent to and contiguous with the side of the solid electrolyte which is exposed to the metal being recovered such that cations of the metal are reduced at the interface between the layer of the secondary electrolyte and the recovered molten metal rather than in or adjacent to the surface of the solid electrolyte.

Referring now to FIG. 1, there is shown an electrolytic separation unit embodying the improvement of the invention. The separation unit includes a first half-cell compartment 13 defined by metal container 15, e.g., Chromel, stainless steel, etc., insulators 17 and 19 and cationically conductive, crystalline, solid electrolyte 21 of the type discussed above, and a second half-cell compartment 23 defined by metal container 25, which may be of the same or different corrosion resistant metal or other material as container 15, insulator 17 and 19, solid electrolyte 21 and a layer of molten salt secondary electrolyte 26 covering the solid electrolyte 21. The secondary electrolyte molten salt 26 comprises a molten salt of the metal being recovered and is (i) ionically conductive to said metal being recovered, (ii) substantially electronically insulating, (iii) substantially insoluble in the recovered molten metal and (iv) nonreactive with the solid electrolyte and the recovered molten metal. The secondary electrolyte may comprise a mixture of mutually soluble molten salts as long as at least one of the salts is a salt of the metal being recovered. If a mixture of salts is employed, it is possible to employ eutectic compositions so that molten salts of lower melting points may be employed, thereby making a lower operating temperature for the cell possible. The molten salt of the metal being recovered is preferably a halide, a cyanide or a sulfide and all of the mutually soluble salts in the secondary electrolyte are preferably selected from halides, cyanides, sulfides and mixtures thereof.

The secondary molten salt electrolyte may be maintained in position in the device by gravity forces or by capillary forces within a porous insulating and corrosion resistant material 24 in which the secondary electrolyte is dispersed and supported. This porous insulating and corrosion resistant material should (i) exhibit a contact angle with the secondary electrolyte molten salt which is less than the contact angle which it exhibits with said recovered molten metal (i.e., the material must be more readily wet by the secondary electrolyte than by the molten metal), (ii) nonreactive with said recovered molten metal, said secondary electrolyte and said solid electrolyte and (iii) substantially electronically insulating. A preferred porous insulating material 24 is boron nitride. All of the support materials may be in the form of porous felts, mats or woven fibers or monolithic porous structures.

Conduit 28 serves to supply and maintain molten salt secondary electrolyte 26 in the region adjacent to solid electrolyte 21. The molten secondary salt electrolyte, as mentioned above, can be a single salt of the recovered metal, e.g., NaCN for sodium recovery, or a mixture of molten salts containing at least one salt of the recovered metal (e.g., ($NaCl+BaCl_2+CaCl_2$) or ($NaCl+NaBr$), etc.). As also mentioned above, all components of the molten salt must be stable to and limitedly soluble in the recovered metal, not reactive to the two solid electrolyte 21 and have limited electronic conductivity.

In the operation of the device as shown in FIG. 1, a molten salt 27, e.g. sodium sulfide, is introduced into compartment 13 by a conduit 29. A first electrode 31, e.g., graphite, is in contact with the metal salt and in electrical connection via conductor 33 with a positive terminal of a DC power source 35. Compartment 23 contains molten recovered metal, e.g., sodium 37. A second electrode 39, e.g., stainless steel, is positioned within compartment 23 in contact with the molten sodium 37 and in electrical connection via conductor 41 with a negative terminal of DC power source 35. When a difference of potential is impressed between electrodes 31 and 39, sodium ions, are separated from the sodium sulfide 27, passed through solid electrolyte 21, through molten secondary electrolyte salt layer 26, and converted into elemental sodium within compartment 23, primarily near the interface between molten sodium 37 and molten salt 26, upon receiving electrons from electrode 39. Sodium is removed from compartment 23 via conduit 43. Compartment 13 is provided with outlet conduit 45 through which the sodium depleted salt can be removed.

Referring now to FIG. 2 there is shown an electrolytic separation unit depicting a preferred embodiment of the apparatus of the invention which is suitable for carrying out the process of the invention. The operation of this unit is similar to that described above regarding FIG. 1 and the numbers corresponding to those in FIG. 1 relate to the same parts and materials described with respect to that figure. The device shown in FIG. 2 offers the additional feature of improved control of the composition of the mixture of molten salts comprising the secondary molten salt electrolyte 26 in cells of extended dimensions wherein the components of the molten salt mixture are slowly consumed at different rates by dissolution into the recovered metal or by a parallel electrolysis reaction of one or more of the salt components.

As is shown in FIG. 2 and in FIG. 3, which is a horizontal cross section thereof, the device comprises a container 15 formed of metal as was the case with respect to the device of FIG. 1 and, a tubular solid electrolyte 21 which is disposed within the container so as to create a first half-cell compartment between the tubular solid electrolyte and the container and the second half-cell compartment within the solid electrolyte. Such a cell having a tubular solid electrolyte disposed within a container could be adapted such that dissociable salt is contained in either of the half-cell compartments and the recovered molten metal in the other. In the particular embodiment shown in FIGS. 2 and 3 the recovered molten metal 37 is contained in the second half-cell compartment and the molten dissociable salt 27 is disposed in the first half-cell compartment. Tubular insulating member 18, e.g., alpha alumina, separates tubular reservoir 26' from solid electrolyte 21 and thus serves to electrically insulate the first half cell compartment from the second.

In the preparation of the cell of FIGS. 2 and 3 the desired mixture of molten salts 26 is fed via conduit 28*a* into the region formed by porous material 24 and adjacent to solid electrolyte 21. Depleted molten salt secondary electrolyte mixture is extracted from the region by a conduit 28*b*. The depleted molten salt secondary electrolyte can be reconstituted to the desired composition in a separate chemical station, not shown, for reuse in the separation cell.

The device shown in these figures incorporates a means of maintaining a secondary electrolyte salt mixture within a limited composition range. It is necessary to maintain this composition range if low melting properties of eutectic mixtures of molten salts are to be utilized. For example, the tertiary eutectic mixture of Sodium, Barium and Calcium chlorides (approximately 38, 47, 15 mole percent) melts at 438° C, whereas the binary eutectic of $NaCl+BaCl_2$ melts at 646° C. The cross sectional view shown in FIG. 3 depicts the cell as being axially symetric, although this is not necessary. The feature of the invention shown in these figures for distributing molten salt so as to minimize composition variation within electrolysis cells is best seen by reference to FIG. 3. The molten salt 26 is distributed axially within slot 22*a* on one side of the solid electrolyte tube 21, and collected within a second slot 22*b* on the opposite side. The slots are sized to provide adequate fluid flow of the molten salt at a rate determined by geometric factors of the molten salt layers formed by porous material 24 and molten secondary electrolyte salt 26, the acceptable variation in salt composition, and the rate of consumption of the components of molten salts 26.

FIG. 4 also shows a preferred apparatus of the invention wherein a tubular solid electrolyte 21 is disposed within container 15 so as to create first and second half cell compartments. In the device shown in this figure the molten dissociable salt 27 is disposed in the first half-cell compartment and recovered molten metal 37 is disposed in the second half-cell compartment as was the case in FIG. 3. Annular member 16 is formed of an insulating material, e.g., alpha-alumina, and serves to electrically insulate the half-cell compartments from each other. The operation of the unit shown in FIG. 4 is similar to that described with respect to FIGS. 1–3 but offers still another alternative and simplified method for providing a molten salt layer adjacent to and covering the inner surface of the solid electrolyte tube 21 and for maintaining the composition of the mixture of molten salts comprising the secondary electrolyte in cells of extended dimensions wherein the components of the molten salt mixture are slowly consumed at different rates by dissolution into the recovered metal or by parallel electrolysis reaction of one or more of the salt components.

Within the second half-cell compartment (i.e., within the tubular electrolyte 21) a cathode structure generally indicated at 120 is inserted. The cathode structure consists of an innertube 121, e.g., of Chromel, end caps 122 and 123 e.g., of Chromel, an outer cylindrical wall of porous material 124, e.g., stainless steel, which is preferentially wet by the recovered metal 37. The recovered metal, e.g., sodium, may be removed from the compartment via conduit 43.

A mixture of molten salts 26 serving as the secondary electrolyte are fed via conduit 28(*a*) in the inside of tube 121 to the end of the separation cell. The salt flows in the gap between the cathode structure 120 and the inner surface of solid electrolyte 121 and is exhausted via conduit 28*b*. The flow of salt could be in the reverse direction to that just described with equal effect.

Porous material 124 which forms the outer wall of cathode structure 120 must be structurally stable, corrosion resistant to the recovered metal and to the secondary electrolyte, and be preferentially wetted by the recovered metal rather than by secondary electrolyte 26. The preferred shape of the outer surface of the porous material consists of expanding grooves or holes so that a meniscus of sodium or other molten metal can form at a location in the groove or hole so that it is stable against an excess pressure in the molten salt secondary electrolyte compared to the pressure in the bulk molten metal. A slight excess pressure is maintained in the molten salts so that a concave surface is formed by the liquid metal such as sodium within the pores.

During operation electrode 39 is in contact with the recovered metal 37 which distributes electrons to the interface between the secondary electrolyte and cathode structure 120. When a difference of potential is impressed between electrodes 31 and 39, sodium ions are separated from salt 27, passed through solid electrolyte 21, through secondary molten salt electrolyte 26, and converted into elemental sodium. The conversion of the cations to elemental sodium occurs primarily near the interface of the secondary electrolyte and cathode structure 120 receiving electrons from electrode 39. The sodium formed at the interface is drawn by capillary forces into the porous material. This causes sodium to flow into the inner compartment, through the conduit 43 and into storage tanks, not shown. In operation of the device, a molten salt 27, e.g., sodium sulfide, is introduced into compartment 13 by a conduit 29. An outlet conduit 45 is provided through which the sodium depleted salt can be removed.

It will be obvious to those skilled in the art that modifications may be made in the various separation cells shown in the drawings and in the details of the foregoing specific discussion of the apparatus and method in the specification without departing from the scope of the invention as set forth in the appended claims.

I claim:

1. In an electrochemical method for recovering a metal from an electrically dissociable salt thereof, which comprises: placing said salt in a molten state in contact with one side of a solid electrolyte that is impermeable to said metal, said salt and the anions of said salt, and selectively conductive with respect to the cations of said metal and said salt; providing a first electrode in contact with said salt on one side of said solid electrolyte; providing a second electrode in contact with said metal on the opposite side of said electrolyte; providing a difference of electrical potential between said first electrode and said second electrode in polarity arrangement adapted to cause unidirectional flow of cations of said metal from said salt through said solid electrolyte and convert said cation to elemental metal, said solid electrolyte comprising a crystalline structure consisting of a crystal lattice and cations of said metal which migrate in relation to said crystal lattice under influence of an electric field, at least a major portion by weight of said cyrstal lattice consisting of ions of aluminum and oxygen in crystal lattice combination, wherein the improvement comprises disposing a molten secondary electrolyte adjacent to and contiguous with said opposite side of said solid electrolyte, said secondary electrolyte comprising a molten salt of said metal being recovered and being (i) ionically conductive to cations of said metal being recovered, (ii) substantially electronically insulating, (iii) substantially insoluble in said recovered molten metal and (iv) nonreactive with said solid electrolyte and said recovered molten metal.

2. A method in accordance with claim 1 wherein said secondary electrolyte is dispersed in and supported by a layer of porous material which (i) exhibits a contact angle with said secondary electrolyte which is less than the contact angle which it exhibits with said recovered molten metal, (ii) is nonreactive with said recovered molten metal, said secondary electrolyte and said solid electrolyte and (iii) is substantially electronically insulating.

3. A method in accordance with claim 2 wherein said porous material with said secondary electrolyte dispersed therein is between about 100 microns and about 2,000 microns in thickness.

4. A method in accordance with claim 1 wherein said molten salt is selected from the group consisting of metal halides, metal cyanides and metal sulfides.

5. A method in accordance with claim 1 wherein said secondary electrolyte is replenished by supplying additional molten salt to the vicinity of said opposite surface of said solid electrolyte.

6. A method in accordance with claim 1 wherein said secondary electrolyte comprises a mixture of mutually soluble molten salts, at least one of which is a salt of said metal being recovered.

7. A method in accordance with claim 6 wherein said mixture of molten salts is near a eutectic composition.

8. A method in accordance with claim 6 wherein said mutually soluble salts are selected from the group consisting of halides, cyanides, sulfides and mixtures thereof.

9. A method in accordance with claim 6, wherein said secondary electrolyte is dispersed in and supported by a layer of porous material which (i) exhibits a contact angle with said secondary electrolyte which is less than the contact angle which it exhibits with said recovered molten metal, (ii) is nonreactive with said recovered molten metal, said secondary electrolyte and said solid electrolyte and (iii) is substantially electronically insulating.

10. A method in accordance with claim 9 wherein the composition of said secondary electrolyte is maintained by continuously supplying and withdrawing said molten salt composition to and from the vicinity of said opposite surface of said solid electrolyte.

11. A method in accordance with claim 9 wherein said material with said secondary electrolyte dispersed therein is between about 100 and about 2,000 microns thick.

12. A method in accordance with claim 1 wherein a porous cathodic structure is disposed along the interface between said secondary electrolyte and said recovered molten metal, said porous cathodic structure being structurally stable and corrosion resistant to said recovered metal and said secondary electrolyte.

13. A method in accordance with claim 12 wherein said cathodic structure is formed of a material which exhibits a contact angle with said recovered metal which is less than the contact angle which it exhibits with said secondary electrolyte.

14. A method in accordance with claim 12 wherein said cathodic structure is formed of a porous material consisting of expanding grooves or holes adapted such that a meniscus of said recovered metal can form at a location in the groove or hole so as to be stable against an excess pressure in said secondary electrolyte compared to the pressure in said recovered metal.

15. In an electrolytic separation unit adapted to carry out an electrolytic method for recovering a metal from an electrically dissociable salt thereof, which unit comprises: (A) a first half-cell compartment containing said salts in a molten state; (B) a second half-cell compartment adapted to receive molten recovered metal; (C) a solid electrolyte which separates and contacts said first and second half-cell compartments and which is (i) impermeable to said metal, said salt and anions of said salt and (ii) selectively conductive with respect to cations of said metal and said solid electrolyte separating said first and second half-cell compartments and consisting of a crystalline structure consisting of a crystal lattice and cations of said metal which migrate in relation to said crystal lattice under influence of an electric field, at least a major portion by weight of said crystal lattice consisting of ions of aluminum and oxygen in crystal lattice combination; and (D) first and second electrodes in contact with (i) said molten salt and said molten metal respectively and (ii) an external circuit such that a difference of electrical potential may be maintained between said first electrode and said second electrode in polarity arrangement adapted to cause unidirectional flow of cations of said metal from said salt through said solid electrolyte and convert said cations to elemental metal, wherein the improvement comprises a secondary electrolyte adjacent to and contiguous with the side of said solid electrolyte contacting said second half-cell compartment, said secondary electrolyte comprising a molten salt of said recovered metal and being (i) ionically conductive to cations of said metal being recovered, (ii) substantially electronically insulating, (iii) substantially insoluble in said molten recovered metal and (iv) nonreactive with said solid electrolyte and said molten recovered metal.

16. A separation unit in accordance with claim 15 wherein said unit is oriented so as to allow said secondary electrolyte to be maintained in position by gravity.

17. A separation unit in accordance with claim 15 wherein said secondary electrolyte salt is selected from the group consisting of metal halides, metal cyanides and metal sulfides.

18. A separation unit in accordance, with claim 15 wherein said secondary electrolyte comprises a mixture of mutually soluble molten salts, at least one of which is a salt of said metal being recovered.

19. A separation unit in accordance with claim 18 wherein said mixture of molten salts is a near eutectic composition.

20. A separation unit in accordance with claim 18 including means for continuously supplying and withdrawing said secondary electrolyte.

21. A separation unit in accordance with claim 15 wherein said secondary electrolyte is dispersed in and supported by a layer of porous material which (i) exhibits a contact angle with said secondary electrolyte which is less than the contact angle which it exhibits with said recovered molten metal, (ii) is nonreactive with said recovered molten metal, said secondary electrolyte and said solid electrolyte and (iii) is substantially electronically insulating.

22. A separation unit in accordance with claim 21 wherein said porous material with said secondary electrolyte dispersed therein is between about 100 and about 2,000 microns thick.

23. A separation unit in accordance with claim 21 wherein said secondary electrolyte comprises a mixture of mutually soluble molten salts, at least one of which is a salt of said metal being recovered.

24. A separation unit in accordance with claim 23 wherein said mixture of molten salt is a near eutectic composition.

25. A separation unit in accordance with claim 24 wherein said mutually soluble molten salts are selected from the group consisting of halides, cyanides, sulfides and mixtures thereof.

26. A separation unit in accordance with claim 23 including means for continuously supplying and withdrawing said secondary electrolyte.

27. A separation unit in accordance with claim 15 wherein a porous cathode structure is disposed within said second half-cell compartment between said secondary electrolyte and said molten recovered metal, said porous cathode structure being structurally stable, and corrosion resistant to said recovered metal and said secondary electrolyte.

28. A separation unit in accordance with claim 27 wherein said porous cathode structure exhibits a contact angle with said molten recovered metal which is less than the contact angle which it exhibits with said secondary electrolyte.

29. A separation unit in accordance with claim 27 wherein the outer surface of the porous material forming said cathode structure consists of expanded grooves or holes such that a meniscus of said molten recovered metal can form at a location in said groove or hole so as to be stable against an excess pressure in said secondary electrolyte compared to the pressure in said molten recovered metal.

30. An apparatus for electrolytically recovering a metal from an electrically dissociable salt thereof comprising: (A) a container; (B) a tubular solid electrolyte which is disposed within said container so as to create a first half-cell compartment between said tubular solid electrolyte and said container and a second half-cell compartment within said solid electrolyte, one of said compartments being adapted to contain said dissociable salt and the other of said compartments being adapted to receive said recovered metal, and said solid electrolyte being (i) impermeable to said metal, said salt and anions of said salts and (ii) selectively conductive with respect to cations of said metal and said salt and consisting of a crystalline structure consisting of a crystal lattice and cations of said metal which migrate in relation to said crystal lattice under the influence of an electric field, at least a major portion by weight of said crystal lattice consisting of aluminum and oxygen in crystal lattice combination; (C) a secondary electrolyte adjacent to and contiguous with the surface of said tubular solid electrolyte which is exposed to said compartment adapted to receive and hold said recovered metal, said secondary electrolyte comprising a molten salt of said metal to be recovered and being (i) ionically conductive to said metal being recovered, (ii) substantially electronically insulating, (iii) substantially insoluble in said molten recovered metal and (iv) nonreactive with said solid electrolyte and said molten recovered metal; and (D) first and second electrodes adapted to be in contact with (i) said molten salt and said molten metal respectively and (ii) an external circuit such that a difference of electrical potential may be maintained between said first electrode and said second electrode in polarity arrangement adapted to cause unidirectional flow of cations of said metal from said salt through said solid electrolyte and said secondary electrolyte and convert said cations to elemental metal.

31. An apparatus in accordance with claim 30 wherein said secondary electrolyte is disposed adjacent to and in contact with the interior surface of said tubular solid electrolyte.

32. An apparatus in accordance with claim 30 wherein said secondary electrolyte is dispersed in and supported by a layer of porous material which (i) exhibits a contact angle with said secondary electrolyte which is less than the contact angle which it exhibits with said recovered molten metal, (ii) is nonreactive with said recovered molten metal, said secondary electrolyte and said solid electrolyte and (iii) is substantially electronically insulating.

33. An apparatus in accordance with claim 32 wherein said secondary electrolyte comprises a mixture of molten salts, at least one of which is a salt of said metal being recovered.

34. An apparatus in accordance with claim 33 wherein said mixture of molten salts is a near eutectic composition.

35. An apparatus in accordance with claim 33 including means for continuously supplying and withdrawing said secondary electrolyte.

36. An apparatus in accordance with claim 31 wherein said secondary electrolyte is disposed along the surface of said tubular solid electrolyte in such a manner as to leave axially extending slots adapted to assist in distributing additional secondary electrolytes.

37. An apparatus in accordance with claim 30 wherein said secondary electrolyte is disposed adjacent to and in contact with the exterior surface of said tubular solid electrolyte.

38. An apparatus in accordance with claim 37 wherein said secondary electrolyte is dispersed in and supported by a layer of porous material which (i) exhibits a contact angle with said secondary electrolyte which is less than the contact angle which it exhibits with said recovered molten metal, (ii) is nonreactive with said recovered molten metal, said secondary electrolyte and said solid electrolyte and (iii) is substantially electronically insultaing.

39. An apparatus in accordance with claim 38 wherein a porous conductive cathode structure is disposed around said secondary electrolyte at the interface between said secondary electrolyte and said recovered molten metal, said porous cathode structure being structurally stable and corrosion resistant to said recovered metal and said secondary electrolyte.

40. An apparatus in accordance with claim 39 wherein said cathode structure is formed of a porous material consisting of expanding grooves or holes adapted such that a meniscus of said recovered molten metal can form at a location in the groove or hole so as to be stable against an excess pressure in said secondary electrolyte compared to the pressure in said recovered metal.

41. A method in accordance with claim 1 wherein said electrically dissociable salt is supplied continuously to said one side of said solid electrolyte and said recovered molten metal is continously withdrawn from said opposite side of said solid electrolyte.

42. An apparatus in accordance with claim 15 including means for continuously supplying said dissociable salt to said apparatus and means for continuously withdrawing said recovered metal from said apparatus.

43. An apparatus in accordance with claim 30 including means for continuously supplying said dissociable salt to said apparatus and means for continuously withdrawing said recovered metal from said apparatus.

* * * * *

UNITED STATES PATENT AND TRADEMARK OFFICE

CERTIFICATE OF CORRECTION

PATENT NO. : 4,108,743

DATED : August 22, 1978

INVENTOR(S) : Robert W. Minck

It is certified that error appears in the above-identified patent and that said Letters Patent are hereby corrected as shown below:

At column 8, lines 53-54, cancel "solid electrolyte separating said first and second half-cell compartments" and replace with --salt--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*